US006325643B1

(12) United States Patent
Ohtsuki et al.

(10) Patent No.: US 6,325,643 B1
(45) Date of Patent: Dec. 4, 2001

(54) PRESS-IN CONTACT

(75) Inventors: Tomonari Ohtsuki; Jin-ichi Mashiyama, both of Tokyo (JP)

(73) Assignee: DDK Ltd. (JP)

( * ) Notice: Subject to any disclaimer, the term of this patent is extended or adjusted under 35 U.S.C. 154(b) by 0 days.

(21) Appl. No.: 09/400,619

(22) Filed: Sep. 20, 1999

(30) Foreign Application Priority Data

Oct. 29, 1998 (JP) ..... 10-308374

(51) Int. Cl.[7] ..... H01R 12/00
(52) U.S. Cl. ..... 439/82; 439/751
(58) Field of Search ..... 439/81–83, 85, 439/86, 751

(56) References Cited

U.S. PATENT DOCUMENTS

| | | | | |
|---|---|---|---|---|
| 5,667,412 | | 9/1997 | Takahaski et al. | 439/751 |
| 5,738,550 | * | 4/1998 | Sakuraoka et al. | 439/751 |
| 5,796,588 | * | 8/1998 | Machida et al. | 361/773 |
| 5,944,563 | * | 8/1999 | Nagafuji | 439/751 |

FOREIGN PATENT DOCUMENTS 8031476 7/1994 (JP) .

07245131 9/1995 (JP) .

* cited by examiner

*Primary Examiner*—Tho D. Ta
*Assistant Examiner*—Ann McCamey
(74) *Attorney, Agent, or Firm*—Baker Botts LLP

(57) ABSTRACT

A press-in contact includes a connection portion to be connected to a circuit of a board or the like, a press-fitting portion to be fixed in a through-hole of a printed circuit board by press-fitting, and a contact portion contacting a contact of a mating connector. The press-fitting portion is formed to have a U-shaped groove in cross-section whose side walls has a thickness becoming thinner toward the open end of the U-shaped groove to make longer its outer peripheries contacting the through hole. A protrusion projecting from the center of the bottom of the U-shaped groove is provided along the full length of the U-shaped groove to an extent such that the protrusion does not adversely affect the flexibility of the ends of the walls of the U-shaped groove at its open end. With this construction, the ends of the walls forming the U-shaped groove are prevented from being deformed inwardly toward each other beyond the elastic limit, thereby maintaining the stable contact between the press-fitting portion of the press-in contact and the through-hole of the printed circuit board.

4 Claims, 4 Drawing Sheets

PRESS-IN CONTACT

BACKGROUND OF THE INVENTION

This invention relates to an improvement of a press-in contact composed of a connection portion to be connected to an electric cable, a circuit of a board or the like, a contact portion to contact a contact of a mating connector, and a press-fitting portion adapted to be fitted in a through-hole of a printed circuit board by press-fitting in a manner eliminating any damage to the press-in contact and the plated through-hole of the printed circuit board, which would otherwise occur.

Hitherto used press-in contacts of this kind are generally made of phosphor bronze or beryllium copper. It is ideal to construct a press-in contact so as to uniformly distribute the stresses on the inner wall of a cylindrical through-hole of a printed circuit board when the press-in contact has been fitted in the through-hole by press-fitting. For this purpose, the press-in contact disclosed in Japanese Patent Application Opened No. H7-245131 includes the press-fit pin having a press-fitting portion which is elastically deformable in its cross-section and adapted to be fitted in a through-hole of a printed circuit board by press-fitting. This press-fitting portion is characterized to have a V-shaped cross-section.

Moreover, Japanese Patent Application No. 186,273/94 filed on Jul. 15, 1994, with Opened No. H8-31476 corresponding to U.S. Pat. No. 5,667,412 filed by the assignee of this application discloses the press-in contact having a press-fitting portion whose inner periphery forms a U-shape groove and outer periphery consists of two arc portions and a straight portion. The straight portion is located between the two arc portions. Circles inscribing the inner periphery and circumscribing the outer periphery are in an eccentric relation and the thickness of walls of the two arc portions becomes progressively thinner toward the open end of the U-shaped groove to provide longer outer peripheries contacting a through-hole.

With the former press-in contact of the prior art, on fitting it in a through-hole of a printed circuit board, the ends of the V- or U-shaped press-fitting portion at its open end have a springiness so as to be resiliently deformed easily, particularly, stepwise deformed at respective parts in accordance with irregularity in diameter of through holes. With the latter press-in contact of the prior art, as the parts of the contact to be press-fitted in a printed circuit board are circular arcs, the area contacting a through-hole becomes larger so that the printed circuit board is uniformly deformed.

With these known press-in contacts, however, due to the irregularities in diameter of through-holes and press-fitting stresses in excess of predetermined values, the distal ends of walls forming the U-shaped cross-section at its open end often tend to deform inwardly toward each other beyond the elastic limit and set in the excess deformation. As a result, the distal ends would separate from the inner wall of the through-hole to reduce the contacting area, resulting in unstable contact between the press-in contact and the printed circuit board and reduction in holding force therebetween.

SUMMARY OF THE INVENTION

It is an object of the invention to provide an improved press-in contact which eliminates all the disadvantages of the press-in contacts of the prior art described above to provide stable holding force and stable contact between the press-in contact and a printed circuit board.

In order to accomplish this object, in press-in contact composed of a connection portion to be connected to an electric cable, a circuit of a board or the like, a press-fitting portion to be fixed in a cylindrical through-hole of a printed circuit board by press-fitting, and a contact portion to contact against a contact of a mating connector, said press-fitting portion formed to have an inner periphery forming a U-shaped groove and an outer periphery having two arc portions and a straight portion between the two arc portions, and circles inscribing the inner periphery of said U-shaped groove and circumscribing the outer periphery being in an eccentric relation, the thickness of walls of said two arc portions becoming progressively thinner toward the open end of the U-shaped groove to make longer said arc portions contacting said through hole, according to the invention a protrusion projecting from the center of the bottom of said U-shaped groove is provided along the full length of said U-shaped groove to an extent such that the protrusion does not adversely affect the flexibility of the ends of the walls of said two arc portions at the open end of the U-shaped groove.

When a press-in contact is being fitted in a through-hole of a printed circuit board by press-fitting, ends of the press-fitting portion of the press-in contact at the open end of the U-shaped cross-section tend to deform inwardly. With the press-in contact thus constructed according to the invention, however, internal stresses will occur in the protrusion located at the bottom of the U-shaped groove, so that the internal stresses oppose the bending of the ends of the press-fitting portion and prevent the plastic deformation of the distal ends as much as possible. Therefore, the press-in contact according to the invention gives the uniform deformation to the inner wall surface of the through-hole of the printed circuit board, as a result of which the contact between the press-in contact and the through-hole is maintained in a stable condition.

As the ends of the walls forming the U-shaped groove of the press-fitting portion of the press-in contact according to the invention have the springiness likely to deform, and the press-fitting portion has the arc portions, the amount of deformation of the printed circuit board can be uniformly distributed. Therefore, stresses acting upon the board are uniformly distributed, so that even if an interference is somewhat large, no whitening occurs in the board and sufficient holding force can be maintained without any reduction of dielectric strength and disconnection in circuits.

The existence of the protrusion according to the invention, moreover, can prevent any plastic-deformation of the ends of the walls forming the U-shaped groove beyond the elastic limit and hence prevent any loss of springiness due to such an excess deformation. In this manner, the protrusion according to the invention can prevent the ends of the press-fitting portion from separating from the inner wall of the through-hole to reduce the contacting area between the press-in contact and the printed circuit board, and hence can prevent the unstable contact therebetween and reduction in holding force against the board.

The invention will be more fully understood by referring to the following detailed specification and claims taken in connection with the appended drawings.

DESCRIPTION OF THE PREFERRED EMBODIMENTS

Figure 1:
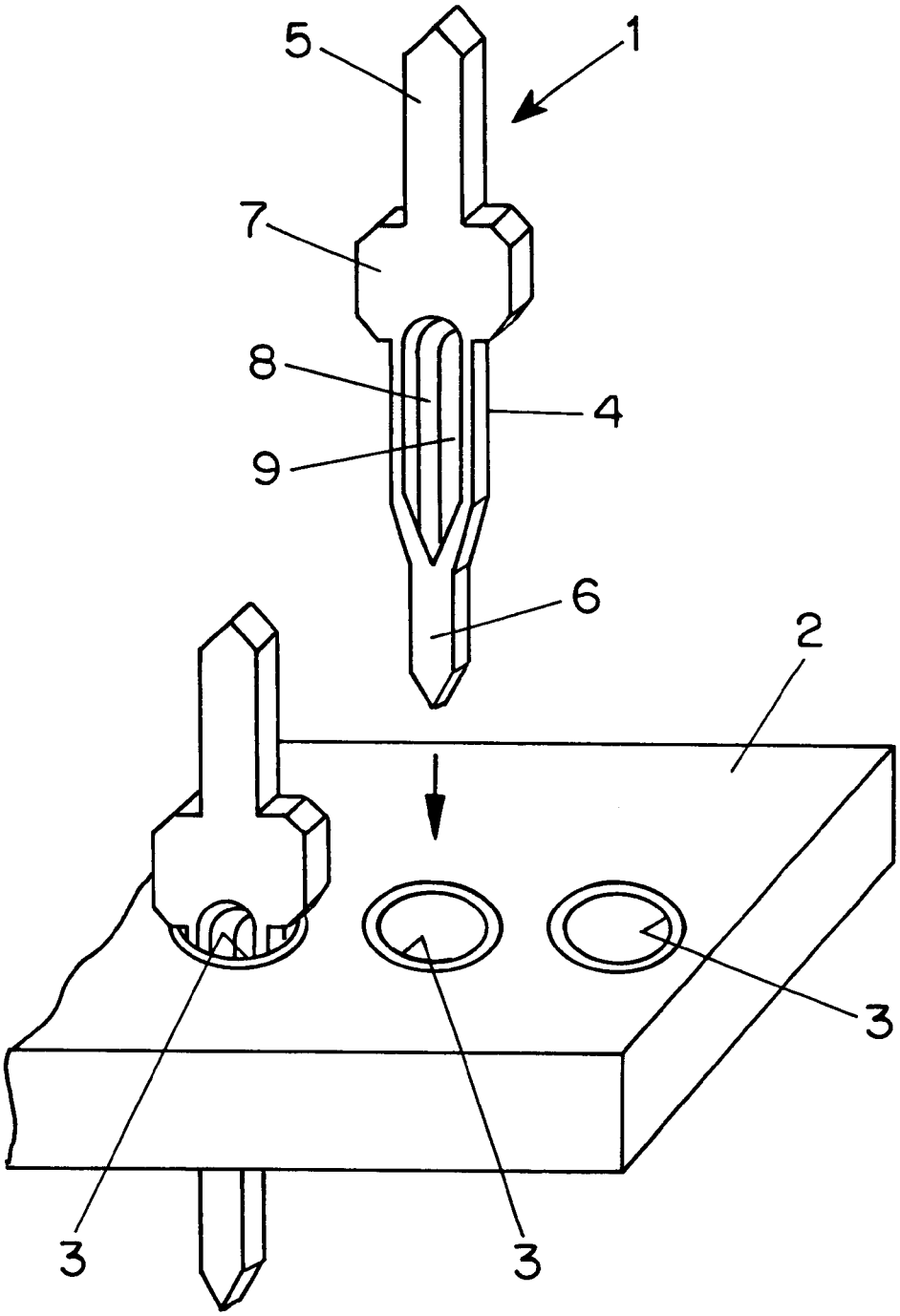
FIG. 1 is a perspective view illustrating the press-in contact according to the invention and the state after the press-in contact has been fitted in a through-hole of a printed circuit board by press-fitting.
Figure 2A:
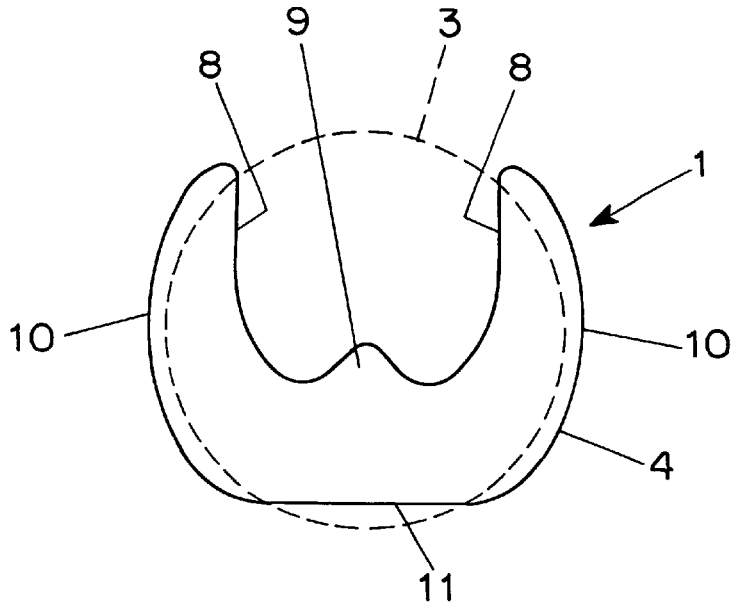
FIG. 2A is a cross-sectional view of the press-fitting portion of the press-in contact according to the invention.
Figure 2B:
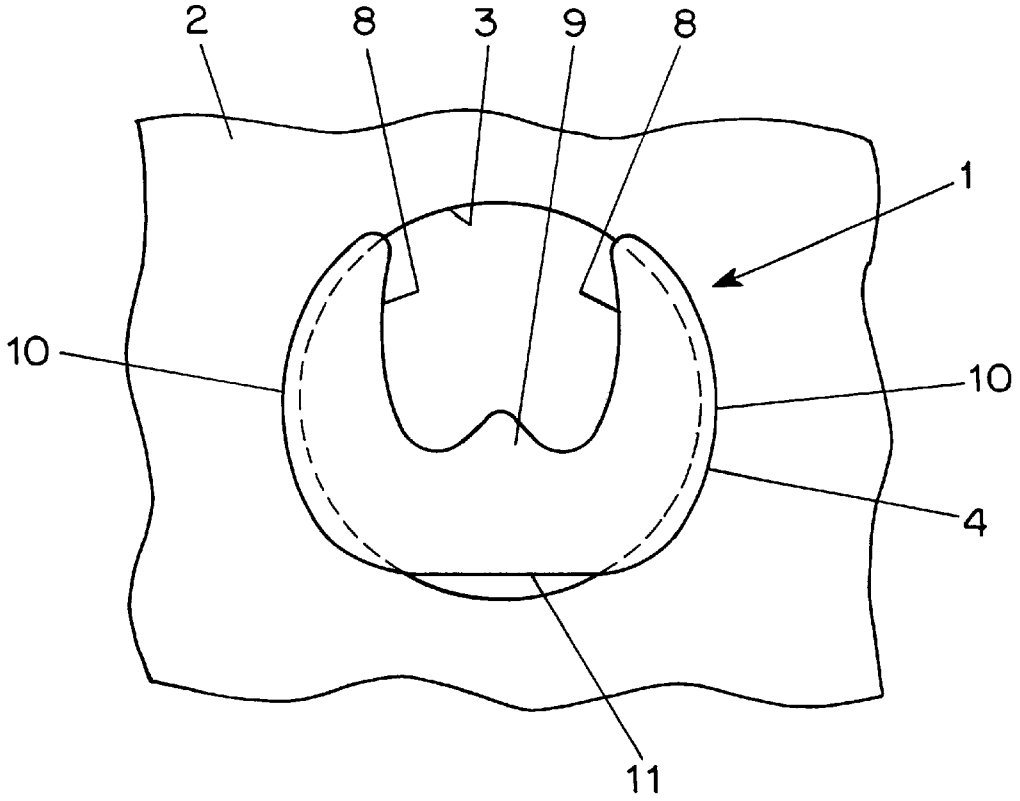
FIG. 2B is a cross-sectional view of the press-fitting portion of the press-in contact shown in FIG. 2A after it has been fitted in the through-hole of a printed circuit board.

One embodiment of the invention will be explained hereinafter with reference to FIGS. 1 and 2. FIG. 1 illustrates in a perspective view a press-in contact 1 according to the invention and another press-in contact according to the invention fitted in a through-hole 3 of a printed circuit board 2 by press-fitting. FIG. 2A shows the positional relation between the cross-section of the press-fitting portion 4 of the press-in contact 1 according to the invention and the through-hole 3 of the printed circuit board 2. FIG. 2B illustrates in cross-section the press-fitting portion 4 of the press-in contact 1 according to the invention which has been fitted in the through-hole 3 of the printed circuit board 2 by press-fitting. Preferred materials of the press-in contact 1 include copper alloys such as phosphor bronze, beryllium copper and the like having a springiness similar to those of the prior art.

The press-in contact 1 according to the invention mainly consists of a connection portion 5, a press-fitting portion 4 and a contact portion 6, these portions being arranged normally in this order. In this embodiment, the press-in contact 1 is provided with a positioning portion 7 between the connection portion 5 and the press-fitting portion 4.

The construction and function of the respective portions of the press-in contact 1 according to the invention will be explained hereinafter. First, the connection portion 5 serves to connect the press-in contact 1 to an electric cable, a circuit of a board or the like (not shown). In this illustrated embodiment, the connection portion 5 is substantially in the form of a prism whose one side in cross-section is 0.64 mm and whose length is of the order of 15.5 mm.

The positioning portion 7 includes a surface adapted to contact a jig (not shown) when the press-in contact 1 is being fitted into the through-hole of a printed circuit board by press-fitting, and a surface adapted to abut against the surface of the printed circuit board 2 when the press-in contact has been fitted in the through-hole of the printed circuit board 2 by press-fitting.

The contact portion 6 of the press-in contact 1 is adapted to contact the contact portion of a contact of a mating connector (not shown) when the press-in contact press-fitted in the through-hole 3 of the printed circuit board has been connected to the mating connector. The contact portion 6 of the press-in contact 1 in the illustrated embodiment has a width of the order of 0.4 mm, a thickness of 0.4 mm and a length of 8.1 mm. The contact portion 6 in the shown embodiment has a particular cross-section obtained by cutting a circle by two parallel straight lines, that is to say, the cross-section having four sides of which opposite two sides are straight lines parallel to each other and the remaining opposite sides are arcs. However, other cross-sections may be used, for example, a circular or rectangular cross-section.

The press-fitting portion 4 of the press-in contact 1 according to the invention has a substantially U-shaped cross-section as shown in FIG. 2, whose inner periphery forms a U-shaped groove 8. A protrusion or ridge 9 is provided at the center of the bottom of the U-shaped groove 8 over its full length so as to project toward the open end of the U-shaped groove 8. The outer periphery of the U-shaped groove 8 consists of two arc portions 10 and a straight portion 11 therebetween. The two arc portions 10 are adapted to contact the inner surface of a through-hole of the printed circuit board.

In the illustrated embodiment, a circle inscribing the inner periphery and a circle circumscribing the outer periphery of the U-shaped groove 8 are in an eccentric relation, whose centers are shifted to each other of the order of 0.07 to 0.1 mm in the direction perpendicular to the bottom of the U-shaped groove 8. When the press-fitting portion 4 of the press-in contact 1 has been press-fitted in the though-hole 3 of the printed circuit board 2, however, the arc portions 10 of the press-fitting portion 4, or a circle circumscribing the forcedly deformed arc portions is of course concentric to the through-hole 3. The nearer to the open end of the U-shaped groove 8, the thinner are the walls forming the U-shaped groove of the press-fitting portion 4 in the cross-section as shown in FIGS. 2A and 2B.

The protrusion 9 of the press-in contact 1 according to the invention is formed in a size to an extent such that it does not adversely affect the flexibility of the ends of the walls forming the U-shaped groove 8. In the illustrated embodiment, the protrusion 9 has a semicircular cross-section whose radius is substantially one half of that of the circle inscribing the inner periphery of the U-shaped groove and extends over the full length of the U-shaped groove as shown in FIG. 1.

In the embodiment shown in FIGS. 1 and 2A, the press-fitting portion 4 of the press-in contact 1 has a with of 0.65 mm, a thickness of 0.49 mm and a length of the order of 3.6 mm. The width depends upon the diameter of the through-hole 3 of a printed circuit board and the length depends upon the thickness of the printed circuit board. The walls forming the U-shaped groove of the press-fitting portion 4 have the thickness of 0.03 to 0.08 mm at the open end of the U-shaped groove, 0.17 to 0.21 mm at the bottom of the groove and 0.1 to 0.14 mm at the intermediate portion.

With such varying thicknesses, a springiness is given to the distal ends of the walls at the open end of the U-shaped groove so that the pressure acting upon the printed circuit board is uniformly distributed when the press-in contact 1 has been fitted in the through-hole 3 of the printed circuit board 2 by press-fitting as shown in FIG. 2B. In other words, the ends of the walls at the open end of the U-shaped groove of the press-fitting portion 4 are deformed according to the principle of a cantilever fixed at its proximal or bottom end to the straight portion 11 or the bottom of the U-shaped groove, thereby accomplishing the uniform distribution of the stresses inside of the through-hole 3.

It is more preferable that the thickness of the walls forming the U-shaped groove of the press-fitting portion 4 progressively decreases from the maximum thickness at the bottom of the U-shaped groove toward the open end of the groove with a decreasing rate which becomes progressively smaller than a constant decreasing rate. Such a decreasing rate may be determined by an analysis with the aid of the finite-element method (FEM).

As shown in FIG. 1, the press-in contact 1 is fitted by press-fitting into the through-hole 3 of the printed circuit board 2 in the direction shown by an arrow. On fitting the press-in contact 1 into the printed circuit board by press-fitting, the walls at the open end of the U-shaped groove of the press-fitting portion 4 may be bent inwardly toward each other or the outer peripheries of the walls at the open-end may be rounded in order to avoid scratching the printed circuit board 2. In order to give the springiness to the ends of the walls at the open end of the U-shaped groove and uniformly distribute the pressure acting upon the printed circuit board 2 from the press-in contact fitted therein by press-fitting, the arc portions 10 may be of a quadratic curve in cross-section such as parabola, ellipse, circle, but a circular arc is preferable.

Figure 3A:
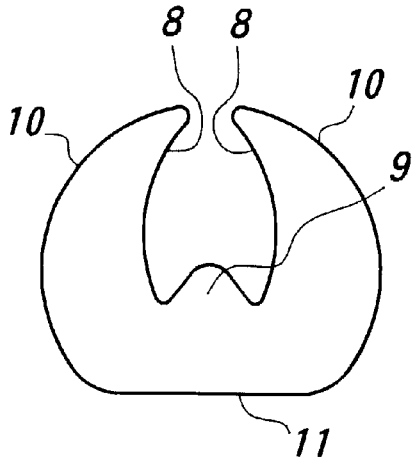
FIGS. 3A, 3B and 3C illustrate various modifications of inner periphery of the press-fitting portion of the press-in contact according to the invention.
Figure 3B:
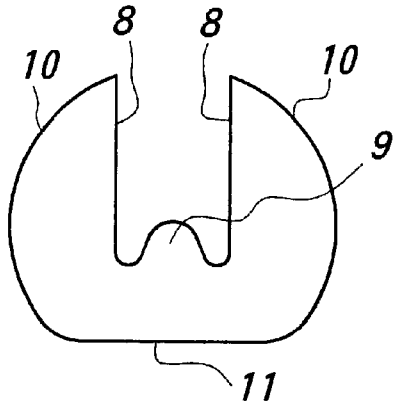
Figure 3C:
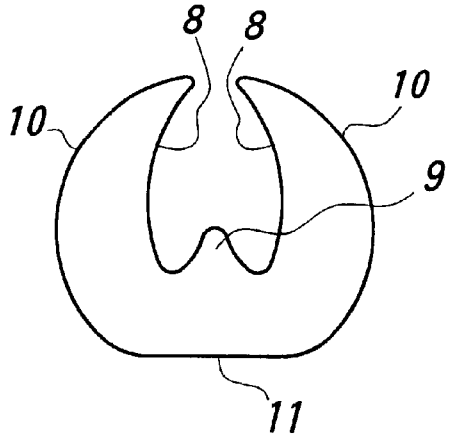

The inner periphery of the press-fitting portion 4 forms the U-shaped groove 8 in section, and the protrusion 9 projects upward from the bottom of the U-shaped groove 8 and extends along its center over its full length as described above. The protrusion 9 has a semicircular cross-section whose radius is substantially one half of that of the circle inscribing the inner periphery of the U-shaped groove 8 and projects upward from the center of the bottom of the U-shaped groove 8. Both the ends of the semicircle of the protrusion 9 are connected to the surface of the bottom of the U-shaped groove 8 with small smooth arcs. The inner periphery of the groove is preferably U-shaped in consideration of manufacture and performance. However, a C-shape, rectangle or the like may be used as shown in FIGS. 3A to 3C, so long as it can fulfill the performance requirements.

The printed circuit board 2 has a thickness of the order of 2.4 mm and the through-hole 3 has a diameter of 0.6 mm. These values depend upon applications to be used. As the dimensions of the press-fitting portion 4 of the press-in contact 1 depend upon the thickness and through-hole diameter of the printed circuit board 2, the press-fitting portion 4 may be suitably designed in dimension each time. In order to improve and maintain the force for holding the press-in contact 1 in the through-hole 3 of the printed circuit board 2, the press-fitting portion 4 has the increased surface area contacting the through-hole and is provided with the protrusion or ridge 9 on the bottom of the U-shaped groove along its center according to the invention.

With 2.4 mm thickness of a printed circuit board 2, in order to obtain the holding force more than 5 kg, an interference of 0.015 mm for press-fitting and a circumferential length of the order of 1 mm contacting the through-hole 3 are needed, so that the length of each of the arc portions 10 is determined to be 0.5 mm. In order to insure such a length of the arc portions 10, the position of the straight portion 11 is determined at a line which is 0.25 mm displaced toward the open end of the U-shaped groove 8 from the tangent to the circle circumscribing the arc portions 10 at the point remotest from the open end of the U-shaped groove 8 or the lowest point viewed in FIG. 2A.

With 0.18 mm radius of the circle inscribing the inner periphery of the U-shaped groove 8, the radius of the protrusion 9 is 0.1 mm. The interference, length of each of the arc portions, the position of the straight portion, the circle inscribing the inner periphery and the size of the protrusion may be suitably selected on the basis of the general pin-contact design standard.

Figure 4A:
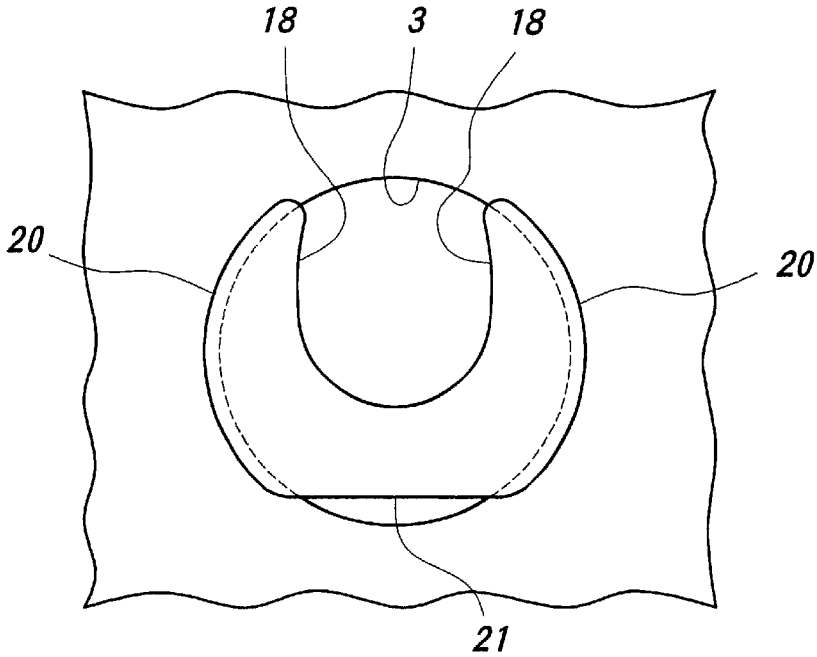
FIG. 4A PRIOR ART
FIG. 4A is a cross-sectional view of the press-fitting portion of a press-in contact of the prior art immediately after it has been fitted in a through-hole of a printed circuit board.
Figure 4B:
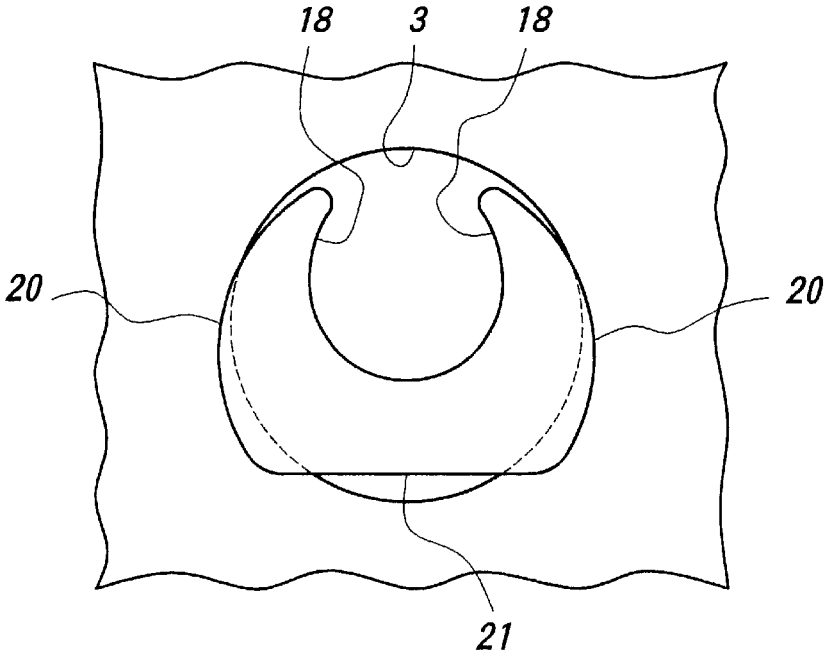
FIG. 4B PRIOR ART
FIG. 4B is a cross-sectional view of the press-fitting portion of the press-in contact shown in FIG. 4A after the press-fitting portion has been deformed.

FIGS. 4A and 4B illustrate the press-in contact of the prior art described above in relation to a printed circuit board for comparing with the press-in contact according to the invention. The press-in contact of FIGS. 4A and 4B has a U-shaped groove 18, two arc portions 20, and a straight portion 21. The press-in contact of the prior art immediately after press-fitted in the printed circuit board is not greatly different from the press-in contact according to the invention shown in FIG. 2B. In FIG. 4B illustrates the press-in contact of the prior art to clarify its disadvantages.

As shown in FIG. 4B, the distal ends of the walls of the press-fitting portion forming the U-shaped groove at its open end are deformed inwardly toward each other beyond the elastic limit due to irregularities in diameters of through-holes and press-fitting stresses in excess of a specified value, so that the distal ends of the press-fitting portion separate from the inner wall of the through-hole to reduce the contacting area between the press-fitting portion and the through-hole, causing unstable contact therebetween and reduction in holding force for the press-in contact to the board, and resulting in an accidental removal of the press-in contact from the printed circuit board.

The press-in contact according to the invention described above is generally manufactured by press-working. In first step, a metal plate blank is punched to form press-in contacts. In next step, the press-fitting portion, which has not been worked in the first step, of each of the press-in contacts, is subjected to drawing into a shape having substantially a V-shaped cross-section having a protrusion along a center line in its inner periphery. In third step, the press-fitting portion having the V-shaped cross-section formed by the drawing in the second step is further subjected to drawing into a shape having an inner periphery of a U-shaped cross-section and an outer periphery of two arc portions and a straight portion. Finally, the press-in contacts in the form of complete contacts are cut away from the metal plate.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A press-in contact composed of a connection portion adapted to be connected to an electric cable or a circuit of a board, a press-fitting portion adapted to be fixed in a cylindrical through-hole of a printed circuit board by press-fitting, and a contact portion adapted to contact a contact of a mating connector, the press-fitting portion having side walls and a base wall joining the side walls, the side walls and the base wall being defined by an inner periphery forming a U-shaped groove and an outer periphery having two arc portions and a straight portion therebetween, circles inscribing the inner periphery of the U-shaped groove and circumscribing the outer periphery being in an eccentric relation, the side walls becoming progressively thinner toward the open end of the U-shaped groove such as to cause the arc portions to contact the through hole, and the press-fitting portion having a protrusion projecting in the direction of the open end of the U-shaped groove from the base wall at the center of the U-shaped groove, the protrusion extending along the full length of the U-shaped groove, and the protrusion having a size such that the protrusion does not adversely affect a flexibility of the ends of the side walls of the two arc portions at the open end of the U-shaped groove, and wherein the protrusion has a semicircular cross-section whose radius is substantially one half of that of the circle inscribing the inner periphery forming the U-shaped groove.

2. A press-in contact as set forth in claim 1, wherein the semicircle of the cross-section of the press-fitting portion has both ends connected to the surface of a base of the U-shaped groove with small smooth arcs.

3. A press-in contact as set forth in claim 1, each of the side walls of the press-fitting portion has a thickness such that the end thereof at the open end of the U-shaped groove is deformed according to the principle of a cantilever to provide a uniform distribution of pressure exerted by the side wall acting upon the inside of the through-hole of the printed circuit board.

4. A press-in contact as set forth in claim 1, wherein each of the side walls of the press-fitting portion has a thickness that progressively decreases toward the open end of the U-shaped groove with a decreasing rate which becomes progressively smaller.

* * * * *